US006149404A

United States Patent [19]

Dobler et al.

[11] Patent Number: 6,149,404

[45] Date of Patent: Nov. 21, 2000

[54] FUEL SUPPLY UNIT

[75] Inventors: Klaus Dobler; Michael Huebel, both of Gerlingen; Willi Strohl, Beilstein, all of Germany

[73] Assignee: Robert Bosch GmbH, Stuttgart, Germany

[21] Appl. No.: 09/214,669

[22] PCT Filed: Feb. 17, 1998

[86] PCT No.: PCT/DE98/00451

§ 371 Date: Jan. 7, 1999

§ 102(e) Date: Jan. 7, 1999

[87] PCT Pub. No.: WO98/59173

PCT Pub. Date: Dec. 30, 1998

[30] Foreign Application Priority Data

Jun. 19, 1997 [DE] Germany ..... 197 25 941

[51] Int. Cl.[7] ..... F04B 17/00

[52] U.S. Cl. ..... 417/356; 417/423.7; 415/55.1; 416/3

[58] Field of Search ..... 417/356, 423.7, 417/423.15; 415/55.1, 55.2, 55.3, 55.4, 10; 416/3

[56] References Cited

U.S. PATENT DOCUMENTS

| | | | |
|---|---|---|---|
| 3,844,674 | 10/1974 | Moriyama | 415/55.1 |
| 4,459,087 | 7/1984 | Barge | 417/356 |

FOREIGN PATENT DOCUMENTS

| | | | |
|---|---|---|---|
| 2012560 | 9/1971 | Germany | 417/423.7 |
| 40 20 521 A1 | 1/1992 | Germany . | |
| WO 95/25885 | 9/1995 | WIPO . | |

*Primary Examiner*—Charles G. Freay
*Assistant Examiner*—Cheryl J. Tyler
*Attorney, Agent, or Firm*—Michael J. Striker

[57] ABSTRACT

A feed unit for fuel, has a pump chamber (14) and an impeller (16) disposed in the pump chamber, an electric motor (12) driving the impeller (16), the electric motor (13) with a rotor formed as the impeller (16) of the feed pump (11), in order to achieve an extremely flat design in the axial direction.

8 Claims, 3 Drawing Sheets

FUEL SUPPLY UNIT

BACKGROUND OF THE INVENTION

The invention relates to a feed unit for fuel.

In a known feed unit of this type, for feeding fuel from a fuel tank to an internal combustion engine of a motor vehicle (International Patent Disclosure WO 95/25885), the feed pump and the electric motor for driving it are disposed side by side in a housing. The pump wheel or impeller, which is occupied by fins or impeller vanes on its circumference, is seated on the shaft of the rotor in a manner fixed against relative rotation; the rotor has a rotor or armature winding, seated in slots, and it revolves in a stator that is occupied by permanent magnet segments. The delivery of current to the armature winding is effected via a commutator or current inverter seated on the rotor shaft and two current brushes resting radially under spring pressure on the commutator.

SUMMARY OF THE INVENTION

The feed unit for fuel according to the invention, has the advantage that by combining the rotating parts of the feed unit, that is, the impeller of the feed pump and the rotor of the electric motor, into a single part, a very simple and compact design is attained, which can be made at little production effort or expense. In particular, the feed unit can be very flat, that is, can have an extremely slight axial dimension. The resultant increasing outer diameter of the feed unit, in conjunction with the usual embodiment of the feed unit, is not only no disadvantage but in fact presents the capability of making additional provisions to improve the efficiency of the feed unit. Dispensing with the commutator and current brushes means that brush wear is not a factor, and the service life of the feed unit is increased. If the electric motor is embodied as a direct current motor, the requisite commutation of the current in the stator winding is done electronically.

In a preferred embodiment of the invention, the cylindrical pump chamber is bounded by two radially extending, axially spaced-apart side walls and a peripheral wall joining the side walls to one another along their circular periphery. The impeller faces each of the side walls with a gap spacing. An internal surface of the stator, formed by a slotted lamination packet forms the peripheral wall of the pump chamber. The impeller has a plurality of circumferentially spaced-apart radial impeller vanes, which between them define axially open vane chambers and which are joined together by an outer ring. The permanent magnets are secured on the outer ring, and if the feed unit is made of plastic are preferably manufactured from plastoferrites.

In an advantageous embodiment of the invention, in each side wall of the outflow conduit, one slotlike side channel, open toward the pump chamber, is embodied concentrically to the impeller axis, with an interruptor rib remaining between the end of the side channel and the beginning of the side channel, with respect to the flow direction. That the beginning of at least one side channel communicates with an intake opening, and the end of the side channel communicates with a pressure outlet; the axes of the inflow and outflow conduits from the intake opening and toward the pressure outlet are oriented either axially or preferably radially. Because of the especially advantageous radial inflow and outflow of fuel into and out of the pump chamber, a substantial reduction in flow losses is achieved, thus improving pump efficiency. The radial oncoming flow and outflow is possible without problems, in contrast to conventional side channel pumps, because of the increased outer diameter of the feed unit resulting from the mode of construction according to the invention, since as a result there is sufficient installation space in the radial direction to accommodate appropriate inflow and outflow conduits.

BRIEF DESCRIPTION OF THE DRAWING

The invention is explained in further detail in the ensuing description in terms of an exemplary embodiment shown in the drawing. The drawings schematically show the following.

DESCRIPTION OF THE PREFERRED EMBODIMENT

Figure 1:
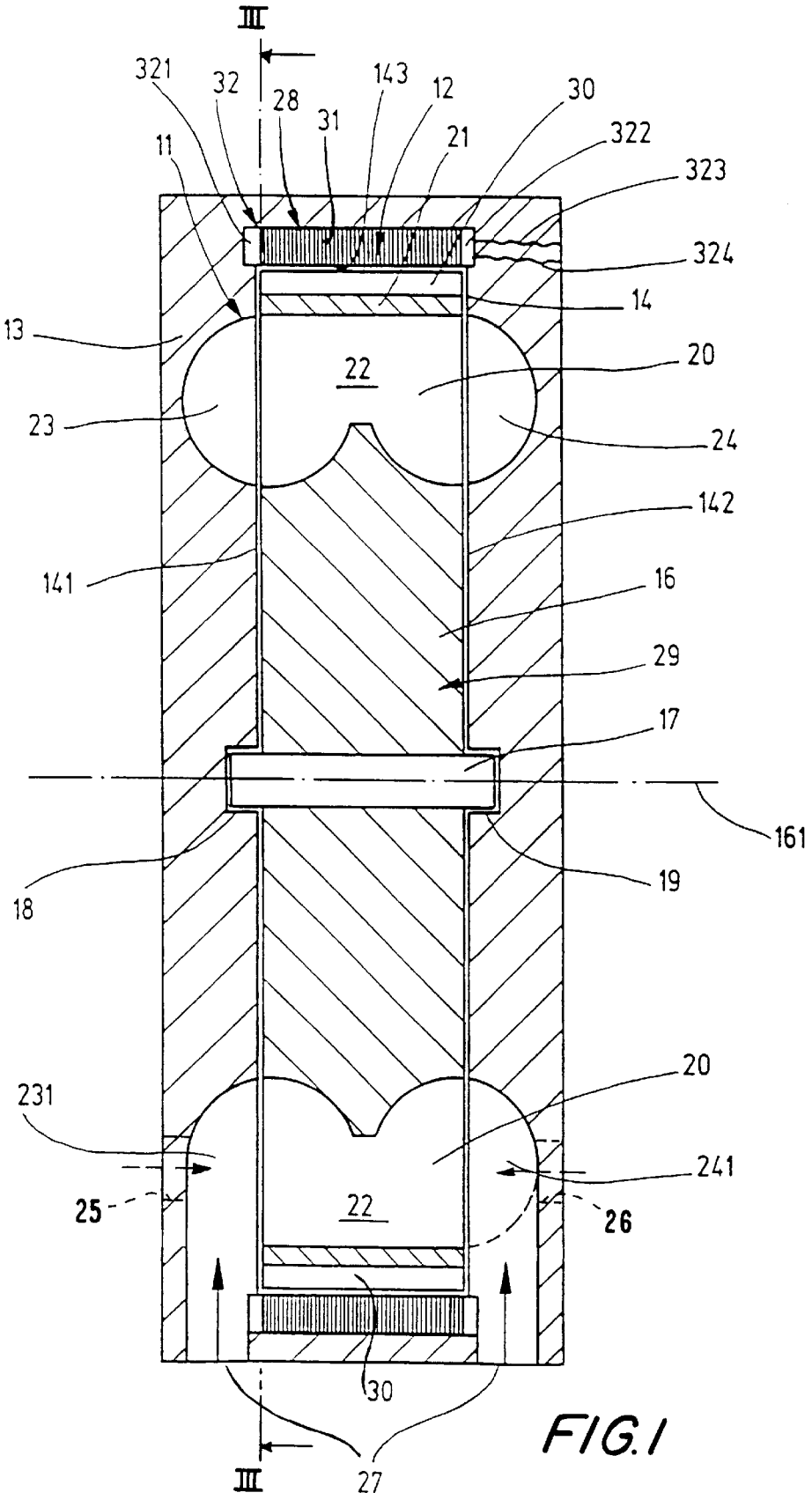
FIG. 1, a longitudinal or meridial section through the feed unit, the section being shown in the upper half of the drawing through the flow region formed and in the lower half of the drawing through the intake region of the feed unit.

The feed unit schematically shown in FIG. 1 is used to feed fuel from a tank to the internal combustion engine of a motor vehicle. Typically, the feed unit is disposed in combination with a filter pot as a so-called tank built-in unit in the fuel container or fuel tank of the motor vehicle. The feed unit has a feed pump 11, embodied as a flow or side channel pump, and an electric motor 12 driving the feed pump 11. The feed pump 11 and the electric motor 12 are received in a common housing 13. The design and mode of operation of the feed pump 11 are known and are described for instance in German Patent Disclosure DE 40 20 521 A1. A pump chamber 14 is embodied in the housing 13; it is defined in the axial direction by two radially extending, axially spaced-apart side walls 141, 142 and in the circumferential direction by a peripheral wall 143 joining the two side walls 141, 142 together along their circular periphery. A pump wheel or impeller 16 is disposed in the pump chamber 14 and is seated on a shaft 17 in a manner fixed against relative rotation. The shaft 17 is received by both of its ends in two bearings 18, 19, which are embodied in the two side walls 141, 142. The axis of the shaft 17 is co-linear with the impeller axis 161 and with the axis of the pump chamber 14. The impeller 16 has a plurality of circumferentially spaced-apart radial impeller vanes 20, only two of which can be seen in the drawing. The impeller vanes 20 are joined by one another to an outer ring 21. Each two impeller vanes 20 between them define a vane chamber 22, which is axially open. The impeller 16 faces the side walls 141, 142 with gap spacing, and the outer ring 21 and the peripheral wall 143 of the pump chamber 14 form a radial gap. In each side wall 141, 142 of the pump chamber 14, a slotlike side channel 23 and 24, respectively, open toward the pump chamber 14 is formed, which is disposed concentrically to the impeller axis 161 and extends over virtually 330° in the circumferential direction from a beginning of a side channel to an end of a side channel; an interrupter rib remains between the end and the beginning of the side channel. In the drawing, only the beginnings 231 and 241 of the side channels 23, 24 can be seen in the lower sectional view of the drawing. The end of the side channel, by comparison, is offset by a circumferential angle of approximately 330°. Each side channel 23, 24 communicates with an intake opening 27 of the feed unit via a respective radially oriented inflow conduit 25 and 26. The ends, not visible here, of the two side channels 23, 24 each communicate via a respective outflow conduit with a compression pipe of the feed unit. In an alternative embodiment of the invention, only the beginning 231 of the side channel 23 communicates with an inflow conduit 25, and only the end of the side channel 24 communicates with an outflow conduit. In that case, the inflow conduit 26 on the right in the sectional view is omitted, and in this region the side channel 24 has a cross section as represented by dashed lines in the drawing. It is furthermore possible for the inflow conduits 25, 26 to be disposed axially, but the radial orientation has the advantage of less flow losses and is easy to achieve between the relatively large outer diameter of the feed unit.

The electric motor 12, embodied with a so-called inner pole rotor, has a stator 28 and a rotor 29 in a known manner, which to achieve an extremely flat design of the feed unit are integrated with the impeller 16 of the feed pump 11. Its magnet poles are formed by permanent magnet segments 30, which are secured to the outer ring 21 of the impeller 16. The stator 28 is embodied as a slotted lamination packet 31, disposed coaxially to the impeller axis 161 in the housing 13 in such a way that the inner annular surface of the lamination packet 31 forms the peripheral wall 143 of the pump chamber 14. An armature winding 32 is typically disposed in the slots of the lamination packet 31; all tat can be seen of the armature winding in the schematic drawing is the two winding heads 321 and 322 on the face end and the two connection lines 323 and 324. In the case of direct current operation, the electric motor 12 is commutated electronically.

If the impeller 16 of the feed pump 11 is made of plastic, then it is advantageous to production if the permanent magnet segments 30 are made from plastoferrites.

Figure 2:
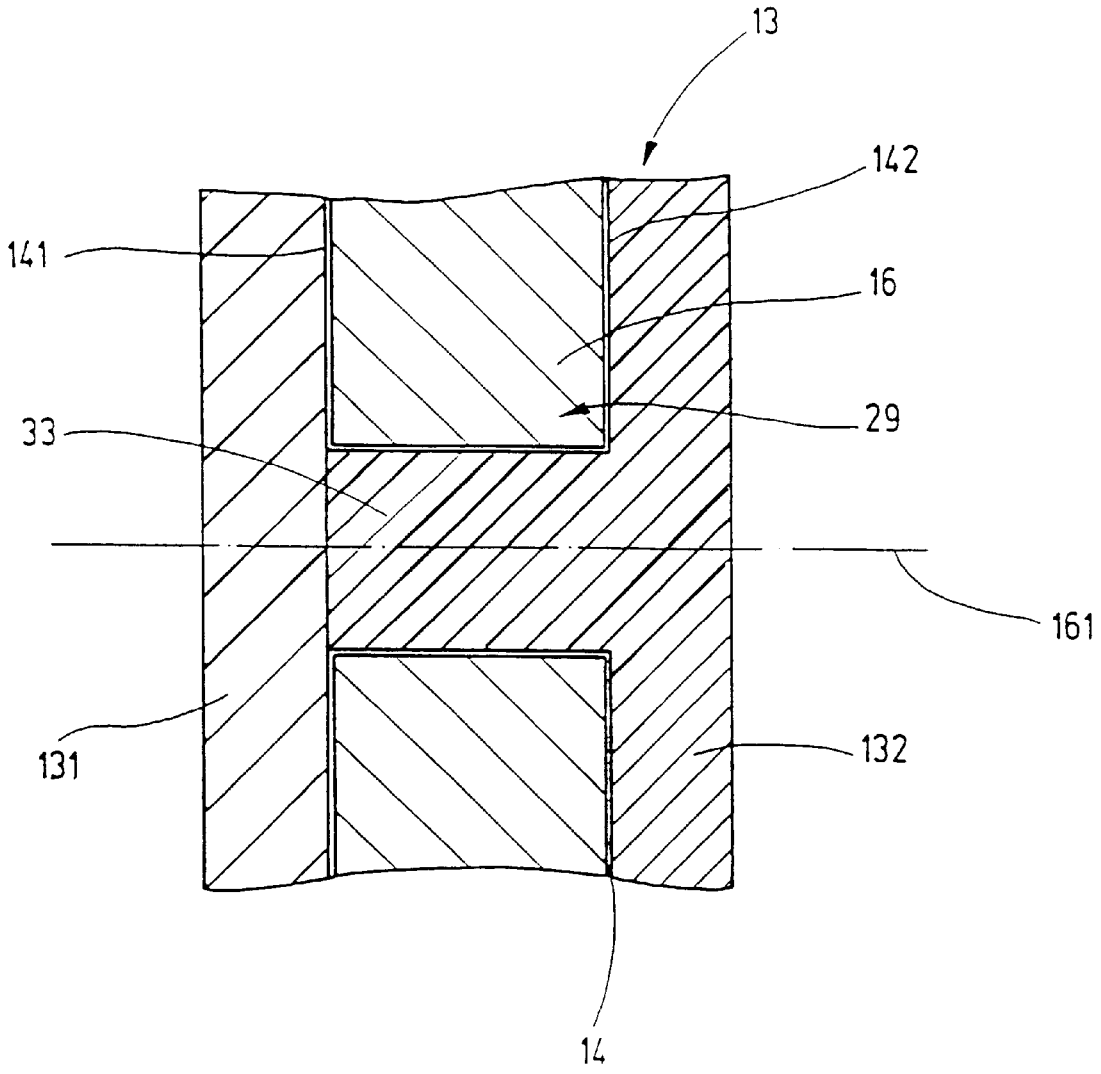
FIG. 2, a detail of the same view as FIG. 1 but of a modified feed unit.
Figure 3:
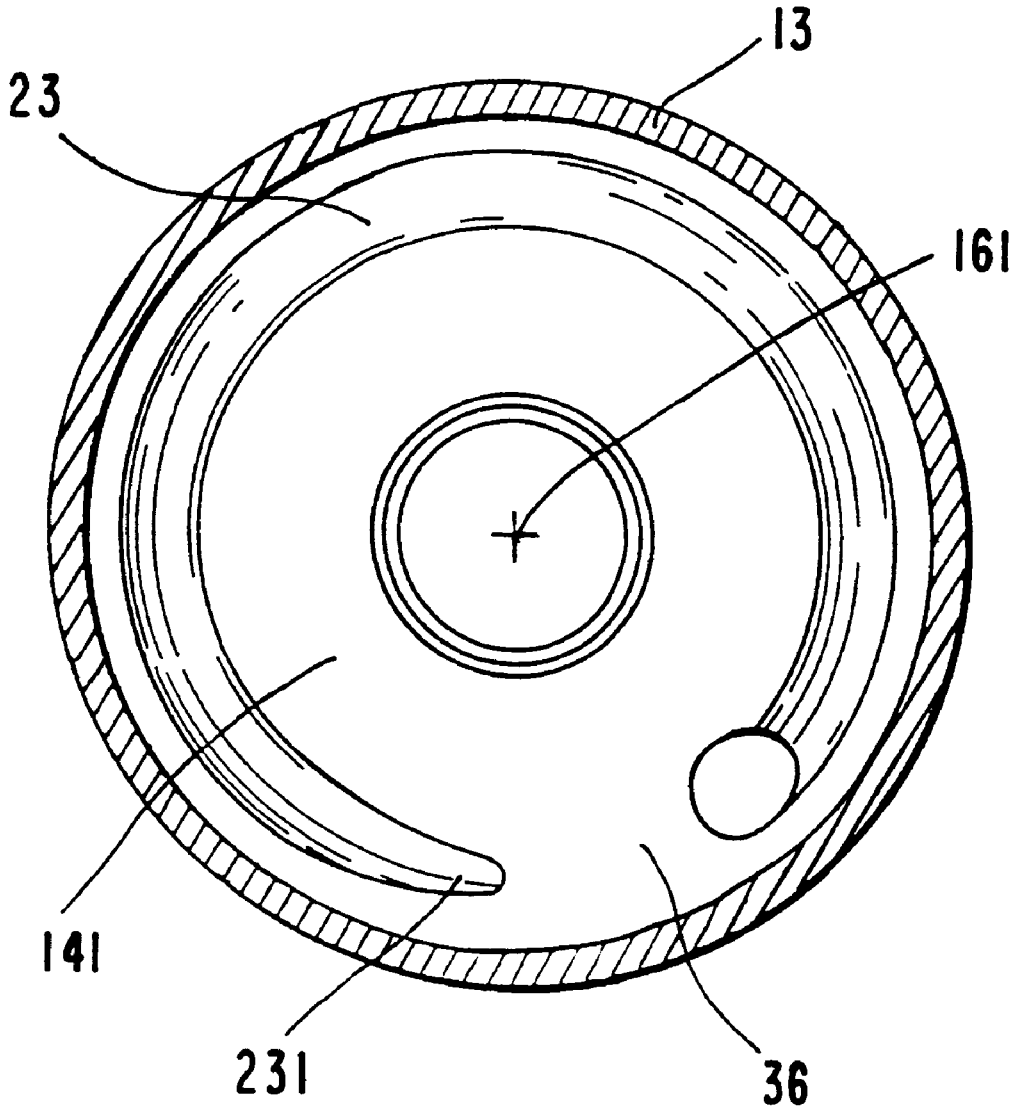
FIG. 3 is a cross-section of the pump along the lines III—III in FIG. 1.

The further exemplary embodiment of the feed unit, shown in section as a detail in FIG. 2, is modified only in terms of the bearing of the impeller 16 in the housing 13 and otherwise agrees with the exemplary embodiment described above, so that identical components are identified by the same reference numerals. The side walls 141 and 142 of the pump chamber 14 are formed here on one side by a cap 131 closing off the housing 13 on the face end and by a radial flange 132 disposed in the housing 13. A journal 33, protruding at right angles into the pump chamber 14, is embodied integrally on the housing flange 132, and the impeller 16 is supported rotating freely on this journal. After the impeller 16 is inserted, the cap 131 is mounted tightly on the housing 13 and solidly joined to it.

What is claimed is:

1. A feed unit for fuel, having a side channel feed pump, which has a pump chamber (14) embodied in a housing (13) and an impeller (16) disposed in the pump chamber (14), and having an electric motor (12) driving the impeller (16), the electric motor having an armature winding (32) and permanent magnets (30) as well as a stator (28) and rotor (29) respectively receiving said armature winding and said permanent magnets, characterized in that the electric motor (12) is a brushless motor, and its rotor (29) is formed by the impeller (16) of the feed pump (11), wherein said pump chamber being defined in an axial direction by two radially extending, axially spaced-apart side walls, each of said side walls having a slotlike side channel open toward said pump chamber, said impeller having a plurality of circumferentially spaced-apart radial impeller vanes facing said side channels in said side walls.

2. The feed unit of claim 1, characterized in that the permanent magnets (30) are disposed on the circumference of the impeller (16), and the stator (28) carrying the armature winding (32) is received in the housing (13) coaxially to the impeller axis (161).

3. A feed unit for fuel, having a side channel feed pump, which has a pump chamber (14) embodied in a housing (13) and an impeller (16) disposed in the pump chamber (14), and having an electric motor (12) driving the impeller (16), the electric motor having an armature winding (32) and permanent magnets (30) as well as a stator (28) and rotor (29) respectively receiving said armature winding and said permanent magnets, characterized in that the electric motor (12) is a brushless motor, and its rotor (29) is formed by the impeller (16) of the feed pump (11), characterized in that the cylindrical pump chamber (14) is bound by two radially extending, axially spaced-apart side walls (141,142) and a peripheral wall (143) joining the side walls (141, 142) to one another along their circular periphery; that the impeller (16) faces each of the side walls (141, 142) with a gap spacing; and that an internal annular surface of the stator (28), formed by a slotted lamination packet (31) forms the peripheral wall (143) of the pump chamber (14).

4. The feed unit of claim 3, characterized in that the impeller (16) has a plurality of circumferentially spaced-apart radial impeller vanes (20), which between them define axially open vane chambers (22) and which are joined together by an outer ring (21); and that the permanent magnets (30) are secured on the outer ring (21).

5. The feed unit of claim 4, characterized in that the permanent magnets (30) are manufactured from plastoferrites.

6. The feed unit of claim 3, characterized in that in each of the side walls (141, 142) of the outflow conduit (14), one slotlike side channel (23, 24), open toward the pump chamber (14), is embodied concentrically to the impeller axis (161), with an interrupter rib remaining between the end of the side channel and the beginning of the side channel; that the beginning (231, 241) of at least one side channel (23, 24) communicates with an intake opening (27) via an inflow conduit (25, 26), and the end of the side channel communicates with a pressure outlet via an outflow conduit.

7. The feed unit of claim 6, characterized in that the axes of the inflow and outflow conduit (25, 26) are oriented radially.

8. The feed unit of claim 6, characterized in that the axes of the inflow and outflow conduit (25, 26) are oriented axially.

* * * * *